US005213023A

United States Patent [19]

Floyd

[11] Patent Number: 5,213,023

[45] Date of Patent: May 25, 1993

[54] HAMMER

[76] Inventor: Ted Floyd, 453 Grand Ave., Spring Valley, Calif. 91977

[21] Appl. No.: 843,937

[22] Filed: Feb. 25, 1992

[51] Int. Cl.[5] ..... B25D 1/00

[52] U.S. Cl. ..... 81/20; 81/23; 254/26 R

[58] Field of Search ..... 81/20, 23, 24; 403/250, 403/251, 277, 409.1; 254/26 R

[56] References Cited

U.S. PATENT DOCUMENTS

| | | | |
|---|---|---|---|
| 418,539 | 12/1889 | Stark | 81/24 |
| 3,128,131 | 4/1964 | Bianchini | 81/20 X |
| 4,890,518 | 1/1990 | Floyd | 81/20 |

*Primary Examiner*—James G. Smith

*Attorney, Agent, or Firm*—Charles C. Logan, II

[57] ABSTRACT

A hammer having unique structure in the handle receiving central portion of its hammer read unit. A wedge unit is formed from two intersecting wedge sections driven into the top end of the handle of the hammer causing the wood to be wedge outwardly in four directions within the handle receiving central portion of the hammer head unit. The wedge unit has a groove in the top surface of one of the wedge sections that allows a nail to be layed horizontally along the top surface of the wedge with part of the nail passing through grooves in the side walls of the handle receiving central portion of the hammer head unit. The wedge unit is also made of magnetic material thereby allowing the nail to be temporarily captured by the wedge unit during the initial stroke of the hammer.

5 Claims, 1 Drawing Sheet

HAMMER

BACKGROUND OF THE INVENTION

The invention relates to a hammer and more specifically to one having novel structure for its hammer head unit and the wedge unit that is driven into the top end of the handle.

Prior art hammers generally have a hammer head unit having a handle receiving central portion that only tapers along two of the inside walls of the opening that receives the top end of the handle. The opening at its bottom end is smaller than at its top end. In order to secure the top end of the handle to the hammer head unit, a linear extending wedge is driven down into the top of the handle spreading it in two directions against the two tapered inside wall surfaces of the opening. Sometimes the linear extending wedge does not hold the top of the handle firmly enough in the hammer head unit and it works loose which is annoying and dangerous during use.

Existing hammers also have no convenient structure that would allow a nail to be held by the to pend of the hammer head unit while starting to hammer the nail in a direction perpendicular to the direction of the hammer is normally struck.

It is an object of the invention to provide a novel wedge unit that provides a more positive structure for securing the top end of the handle to the hammer head unit.

It is also an object of the invention to provide a novel hammer that has structure both in the top end of the handle receiving central portion of the hammer head unit and also in the wedge unit that allows a nail to be magnetically held in position during hammer strokes made perpendicular to the normal direction in which the hammer unit is swung.

SUMMARY OF THE INVENTION

The novel hammer has a hammer head unit having a handle receiving central portion. A 4-sided bore hole extends from the top edge of the handle receiving central portion to its bottom edge. The 4-sided bore hole is in alignment with the vertical axis of the handle receiving central portion. The 4-sided bore hole is formed by a front inside wall, a rear inside wall, and left and right inside walls. All four of these inside walls taper outwardly at a predetermined angle from their bottom edges to their top edges.

The wedge unit has been designed to interrelate with the 4-sided bore hole of the handle receiving central portion of the hammer head unit. The wedge unit is formed by an X-axis wedge section that intersects the Z-axis wedge section at 90 degrees. The length of these two wedge sections is less than the dimensions of the length and width of the 4-sided bore hole. The wedge unit is driven down into the top end of the handle after the wedge has been inserted upwardly through the 4-sided bore hole. Due to the wedge unit having four fingers that are perpendicular to each other, when it is driven into the top end of the handle it spreads the wood into four directions at 90 degree angles to each other. This wedges the top end of the handle tightly within the interior of the 4-sided bore hole and grips it in place. There are a plurality of horizontal barbs on each of the wedge sections that increase the gripping power of the wedge unit into the wood of the handle.

The top surface of the Z-axis wedge section is positioned a predetermined height below the top surface of the X-axis wedge section thereby forming a laterally extending groove in the top surface of the X-axis wedge section. This structure is important because the wedge unit is made of a magnetic material such as Alnico or Alcomax. This magnetic material allows a nail to be layed on the top surface of the Z-axis wedge section along its entire length and be captured by the magnetic properties of the wedge unit. The wedge unit is pounded into the top end of the handle until the wedge unit and the top of the handle are flush with the top edge of the handle receiving central portion. It is therefore necessary that a groove be formed along the top edge of the side wall of the handle receiving central portion. It is therefore necessary that a groove be formed along the top edge of the side wall of the handle receiving central portion. This allows a nail captured on the top surface of the Z-axis wedge section to have its bottom end pass through the groove while the head of the nail would abut the other side all of the handle receiving central portion. This feature of the hammer is used when it is desirable to start a nail in a location which does not allow the head of the hammer to be used. The head is turned perpendicular to its normal direction of usage and the nail can be started by short lateral motions of the hammer unit in the direction of the axis of the nail which is captured in its top surface.

DESCRIPTION OF THE PREFERRED EMBODIMENT

Figure 1:
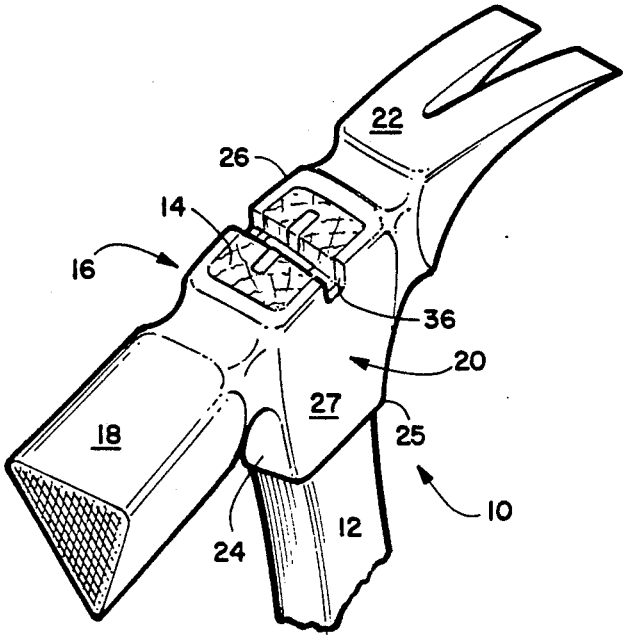
FIG. 1 is a partial front perspective view of the novel hammer.
Figure 2:
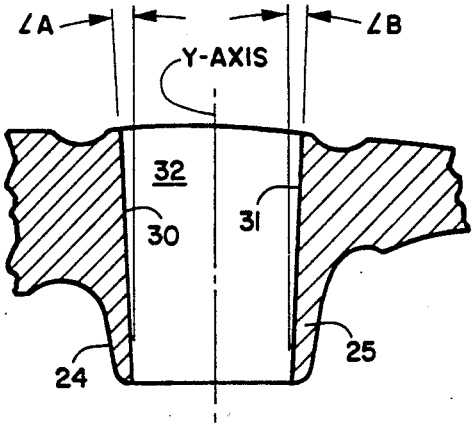
FIG. 2 is a partial cross sectional view illustrating the interior surfaces of the 4-sided bore hole.
Figure 3:
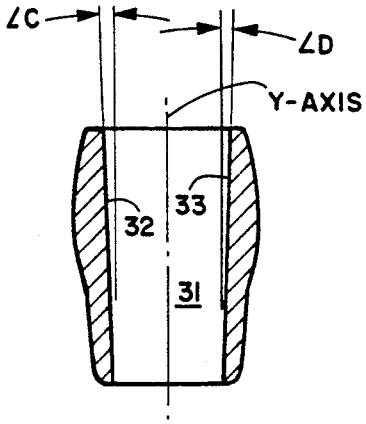
FIG. 3 is a cross sectional view taken perpendicular to FIG. 2 and showing the inside wall surfaces of the 4-sided bore hole.
Figure 4:
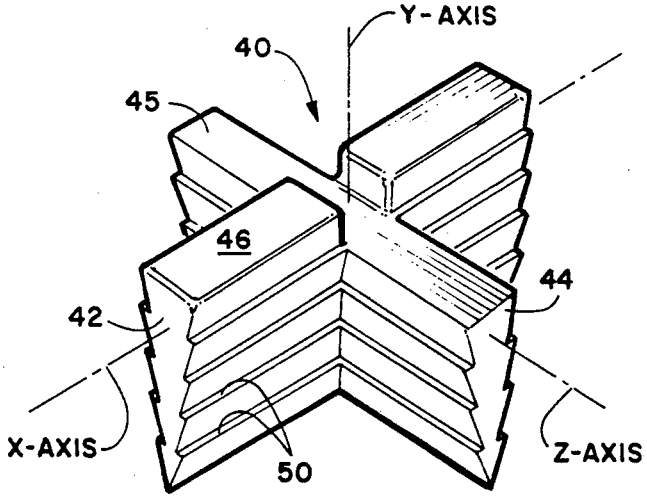
FIG. 4 is an enlarged front perspective view of the wedge unit.
Figure 5:
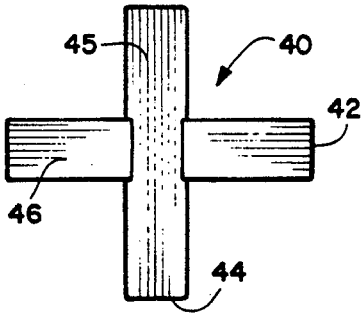
FIG. 5 is a top plan view of the wedge unit.
Figure 6:
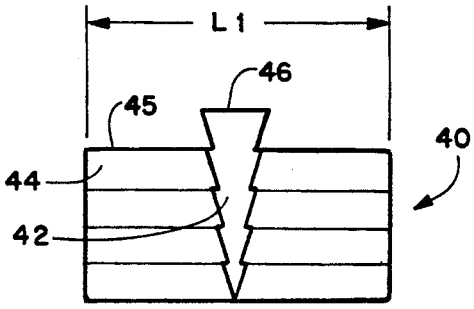
FIG. 6 is a side elevation view of the wedge unit.
Figure 7:
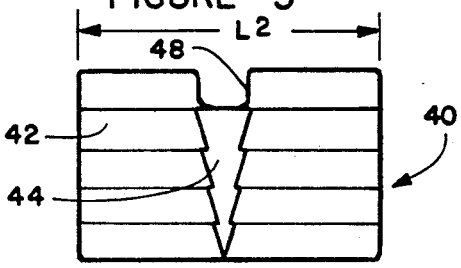
FIG. 7 is a side elevation view taken at 90 degrees to FIG. 6 of the wedge unit.

The novel hammer and its wedge unit will now be described by referring to FIGS. 1–7 of the drawing. The hammer is generally designated numeral 10.

Hammer 10 has a handle 10 having a top end 14.

Hammer head unit 16 has a hammer portion 18, a handle receiving central portion 20 and a claw portion 22.

Handle receiving central portion 20 has a front wall 24, a rear wall 25, a left side all 26 and a right side wall 27.

Handle receiving central portion 20 has a 4-sided bore hole that extends longitudinally along the Y-axis. The 4-sided bore hole is formed by a front inside wall 30, a rear inside wall 31, a left inside wall 32 and a right inside wall 33. Front inside wall 30 tapers upwardly and outwardly at an angle A. Rear inside wall 31 tapers upwardly and outwardly at an angle B. Left inside wall 32 tapers upwardly and outwardly at an angle C and right inside wall 33 tapers upwardly and outwardly at angle D. Angles A,B,C and D range between 1 and 5 degrees. The top edge of side wall 27 has a groove 36 formed therein to provide an opening through which passes the shank of a nail.

Wedge unit 40 is formed from an X-axis wedge section 42 and a Z-axis wedge section 44. The top surface 45 of Z-axis wedge section 44 is spaced a predetermined distance below the top surface 46 of X-axis wedge section 42. This forms a groove 48 in top surface 46 and thus allows a nail to have its shank lie entirely on the top surface 45 with its bottom end extending through groove 36. The nail would be held in place due to the magnetic properties of the material of the wedge unit. A plurality of horizontal barbs 50 are vertically spaced upon the outer surfaces of the respective wedge sections 42 and 44. Z-axis wedge section 44 would have a predetermined length L1 that would be less than the width of the 4-sided bore hole. X-axis wedge section 42 would have a length L2 that would be less than the length of the 4-sided bore hole. This is critical since it is necessary that the wedge unit be spaced a predetermined distance from the metal of the handle receiving central portion 20.

What is claimed is:

1. A hammer comprising:

a handle having a top end;

a hammer head unit having a hammer portion, a handle receiving central portion and claw portion;

said handle receiving central portion having a top edge, a bottom edge, a vertical Y-axis and a 4-sided bore hole that extends along said Y-axis from said bottom edge to said top edge;

said 4-sided bore hole having a front inside wall, a rear inside wall, and left and right inside walls, the respective inside walls taper outwardly from their bottom edge to their top edge to that the top end of said 4-sided bore hole is greater its size than its bottom end;

a wedge unit having an X-axis wedge section and a Z-axis wedge section that intersect each at a predetermined angle, the respective wedge sections have predetermined lengths L1 and L2, said X-axis wedge section having a top surface and a bottom surface; said Z-axis wedge section intersects said X-axis wedge section along a vertical Y-axis; said Z-axis wedge section having a top surface and a bottom surface and its top surface being spaced downwardly from the top surface of said X-axis wedge section to thereby form a groove that matingly receives a nail that is positioned horizontally across the entire length of the top surface of said Z-axis wedge section; and said wedge section being driven into the top end of said handle within the perimeter formed by the top end of said 4-sided bore hole.

2. A hammer as recited in claim 1 wherein said wedge unit is made of magnetic material.

3. A hammer as recited in claim 1 wherein said wedge sections of said wedge unit have a plurality of horizontal barbs that function to lock said wedge unit into the top end of the handle of a hammer.

4. A hammer as recited in claim 1 wherein the top edge of one of the side walls of said handle receiving central portion has a groove for removably receiving the body of a nail.

5. A wedge unit for a hammer comprising:

said wedge unit formed from an X-axis wedge section and a Z-axis wedge section that intersect each other at a predetermined angle, the respective wedge sections have predetermined lengths L1 and L2, said X-axis wedge section having a top surface and a bottom surface, said Z-axis wedge section intersects said X-axis wedge section along a vertical Y-axis, said Z-axis wedge section having a top surface and a bottom surface and its top surface being spaced downwardly from the top surface of said X-axis wedge section to thereby form a groove that matingly receives a nail that is positioned horizontally across the entire length of the top surface of said Z-axis wedge section, said wedge section being designed to be driven into the top end of the handle of a hammer within the perimeter formed by the top end of a 4-sided bore hole.

* * * * *